US011534004B2

(12) United States Patent
Rundle

(10) Patent No.: US 11,534,004 B2
(45) Date of Patent: Dec. 27, 2022

(54) BUNK BED

(71) Applicant: Evan Rundle, Miami, FL (US)

(72) Inventor: Evan Rundle, Miami, FL (US)

( * ) Notice: Subject to any disclaimer, the term of this patent is extended or adjusted under 35 U.S.C. 154(b) by 0 days.

(21) Appl. No.: 17/097,420

(22) Filed: Nov. 13, 2020

(65) Prior Publication Data

US 2021/0145182 A1 May 20, 2021

Related U.S. Application Data

(60) Provisional application No. 62/934,799, filed on Nov. 13, 2019.

(51) Int. Cl.

| | |
|---|---|
| ***A47C 19/20*** | (2006.01) |
| ***A47B 83/00*** | (2006.01) |
| ***A47C 17/50*** | (2006.01) |
| ***A47B 87/02*** | (2006.01) |
| *B61D 31/00* | (2006.01) |

(52) U.S. Cl.

CPC ..... *A47C 19/20* (2013.01); *A47B 83/00* (2013.01); *A47B 87/0215* (2013.01); *A47B 87/0276* (2013.01); *A47C 17/50* (2013.01); *B61D 31/00* (2013.01)

(58) Field of Classification Search

CPC ..... A47C 19/20; A47C 19/202; A47C 19/205; A47C 17/50; A47C 19/207; A47C 19/22; A47C 21/08; E06C 1/00; E06C 9/00; E06C 9/02; A47B 83/00; A47B 87/0215; A47B 87/0276; B61D 31/00; A47D 15/008; E04H 1/04

See application file for complete search history.

(56) References Cited

FOREIGN PATENT DOCUMENTS

| | | | | |
|---|---|---|---|---|
| CN | 107080395 | * | 8/2017 | ..... A47C 19/22 |
| CN | 111955999 A | * | 11/2020 | ..... A47C 19/20 |
| KR | 200448107 | * | 3/2010 | ..... A47B 3/04 |

* cited by examiner

*Primary Examiner* — David R Hare
*Assistant Examiner* — Madison Emanski
(74) *Attorney, Agent, or Firm* — Rafael Perez-Pineiro; The Brickell IP Group, PLLC

(57) ABSTRACT

A double bunk bed loft system having a staircase and landing on both the lower and upper levels which create hallways between the individual bunks. The hallway allows for users to stand up, but because the placement of upper bunks is over the lower bunks above the beds, the entire bunk system is shorter and saves vertical space. To create a more spacious feel for the lower bunk, the system is designed using exposed beams to support the upper bunk. The upper level remains open to add height.

6 Claims, 4 Drawing Sheets

BUNK BED

CROSS REFERENCE TO RELATED APPLICATIONS

This application claims the benefit of U.S. Provisional Application No. 62/934,799 filed Nov. 13, 2019, the disclosure of which is hereby incorporated herein by reference in its entirety.

FIELD OF THE INVENTION

Embodiments of the present invention generally relate to a bunk beds in loft spaces.

BACKGROUND

The present invention relates generally to the field of bunk beds and expands the idea of the loft system for affordable co-living. Bunk beds have an upper and lower bunk with a ladder or set of stairs providing access to the top bunk. Due to the continued increase of housing costs in urban areas, many people now choose to rent space in a bunk bed as an affordable, flexible, and alternative form of housing. The loft system connects two sets of lower and upper bunk beds providing sleeping quarters for multiple people in a compact space. The multi-floored bunk bed systems currently in the market consist of two lower bunks and two enclosed upper bunks. There currently are no multi-floored bunk bed systems that connect the upper level bunks with a landing area at the top of the stairs. Therefore, there is a need in the art for creating a hallway for the upper level users and keeping that level open to save vertical space by making the entire bunk system shorter and creating a more spacious feel for both the upper and lower levels.

SUMMARY

The following presents a simplified summary of the invention in order to provide a basic understanding of some aspects of the invention. This summary is not an extensive overview of the invention. Rather than specifically identifying key or critical elements of the invention or to delineate the scope of the invention, its purpose, inter alia, is to present some concepts of the invention in a simplified form as a prelude to the more detailed description that is presented later.

The disclosure relates to a multi-floored bunk bed system composed of two interconnected beds on a lower level and two interconnected beds on an upper level in accordance with one implementation. The two floors may be connected by a staircase in the center of both beds and which has a landing at the top of the stairs which creates a hallway between the upper bunks. The advantage of this non-enclosed, multi-level bunk bed system is that it saves vertical space and creates a more spacious sleeping, standing, living, and egress area for each of the individual quarters of the loft system.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other advantages and novel features of the invention will become apparent from the following description of the invention when considered in conjunction with the drawings.

DETAILED DESCRIPTION

The foregoing summary, as well as the following detailed description of certain embodiments of the subject matter set forth herein, will be better understood when read in conjunction with the appended drawings. In the following detailed description, reference is made to the accompanying drawings which form a part hereof, and in which are shown by way of illustration specific embodiments in which the subject matter disclosed herein may be practiced. These embodiments, which are also referred to herein as "examples," are described in sufficient detail to enable those skilled in the art to practice the subject matter disclosed herein. It is to be understood that the embodiments may be combined or that other embodiments may be utilized, and that variations may be made without departing from the scope of the subject matter disclosed herein. It should also be understood that the drawings are not necessarily to scale and in certain instances details may have been omitted, which are not necessary for an understanding of the disclosure, such as details of fabrication and assembly. Furthermore, references to "one embodiment" are not intended to be interpreted as excluding the existence of additional embodiments that also incorporate the recited features. The following detailed description is, therefore, not to be taken in a limiting sense, and the scope of the subject matter disclosed herein is defined by the appended claims and their equivalents.

Figure 1:
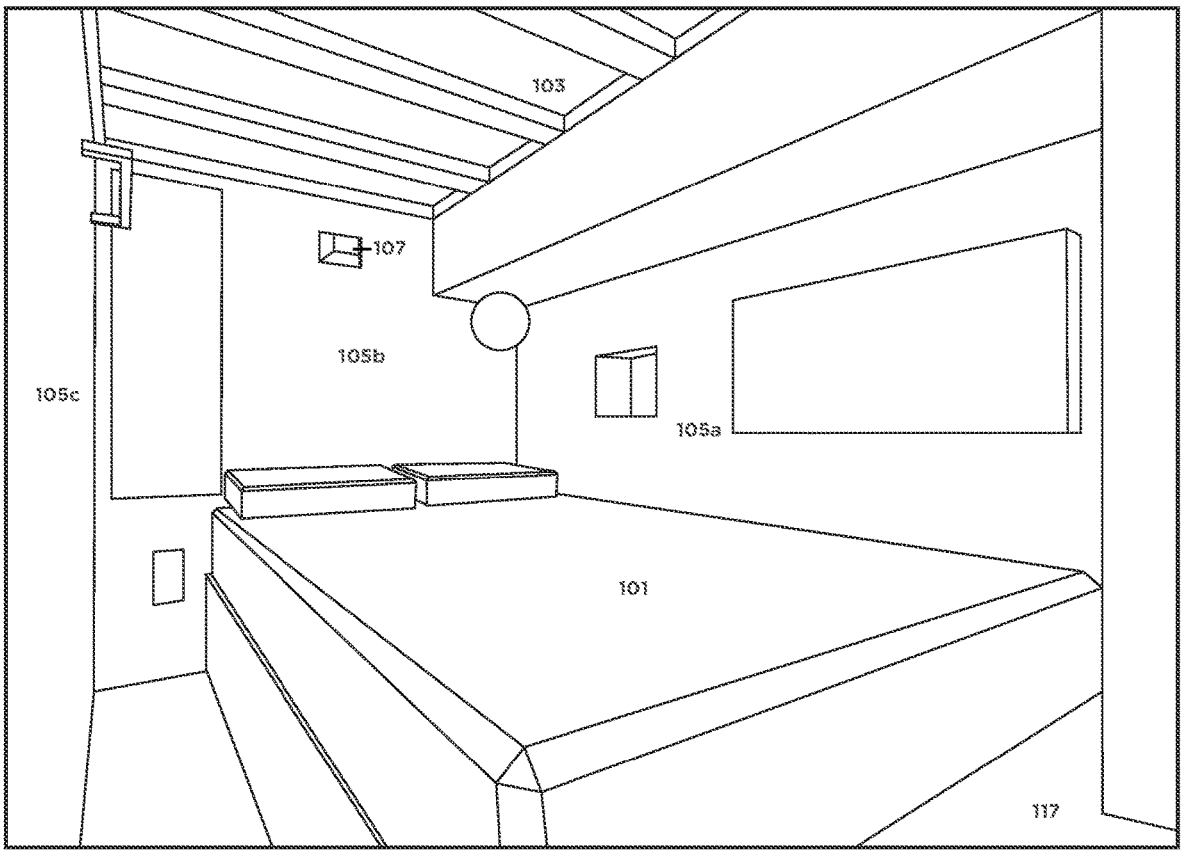
FIG. 1 shows a bunk bed within a loft space in accordance with one implementation of the disclosure.

FIG. 1 shows a lower bunk from a four bunk bed assembly within a loft space in accordance with one implementation of the disclosure. The lower bunk may include a hallway 117; walls 105*a-c*; a bed 101; wood beams 103; and a light fixture 107.

Figure 2:
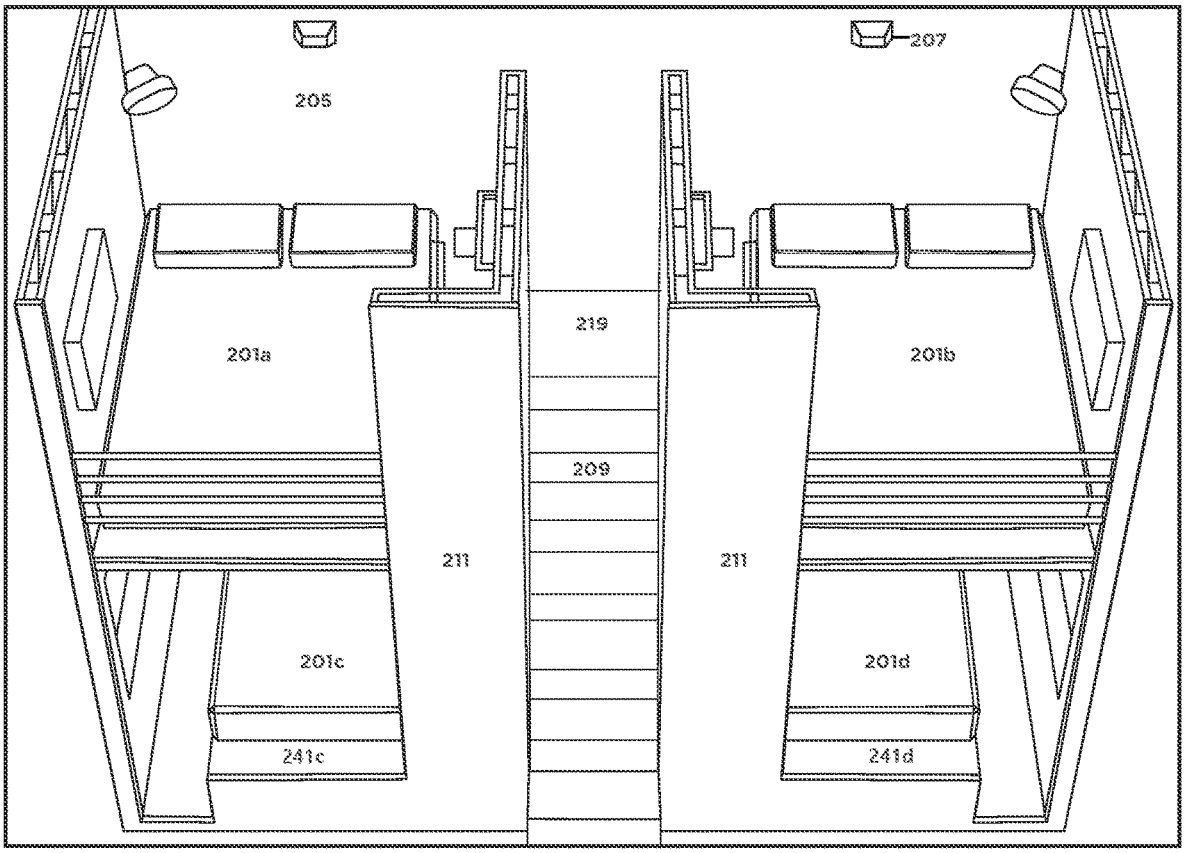
FIG. 2 illustrates the bunk beds as seen from the top view with the hallway between each bunk to connect them horizontally, and the wood beams that encase the two levels vertically, in accordance with one implementation of the disclosure.

FIG. 2 illustrates the four bunk bed assembly as seen from the top view with the hallway between each bunk to connect them horizontally, and the wood beams that encase the two levels vertically, in accordance with one implementation of the disclosure. The bunk bed assembly may include two upper bunk beds 201*a-b*; two lower bunk beds 201*c-d*; a staircase 209 and corresponding landing 219; back wall 205; lighting fixture 207; and L-shaped wood beams 211.

Figure 3:
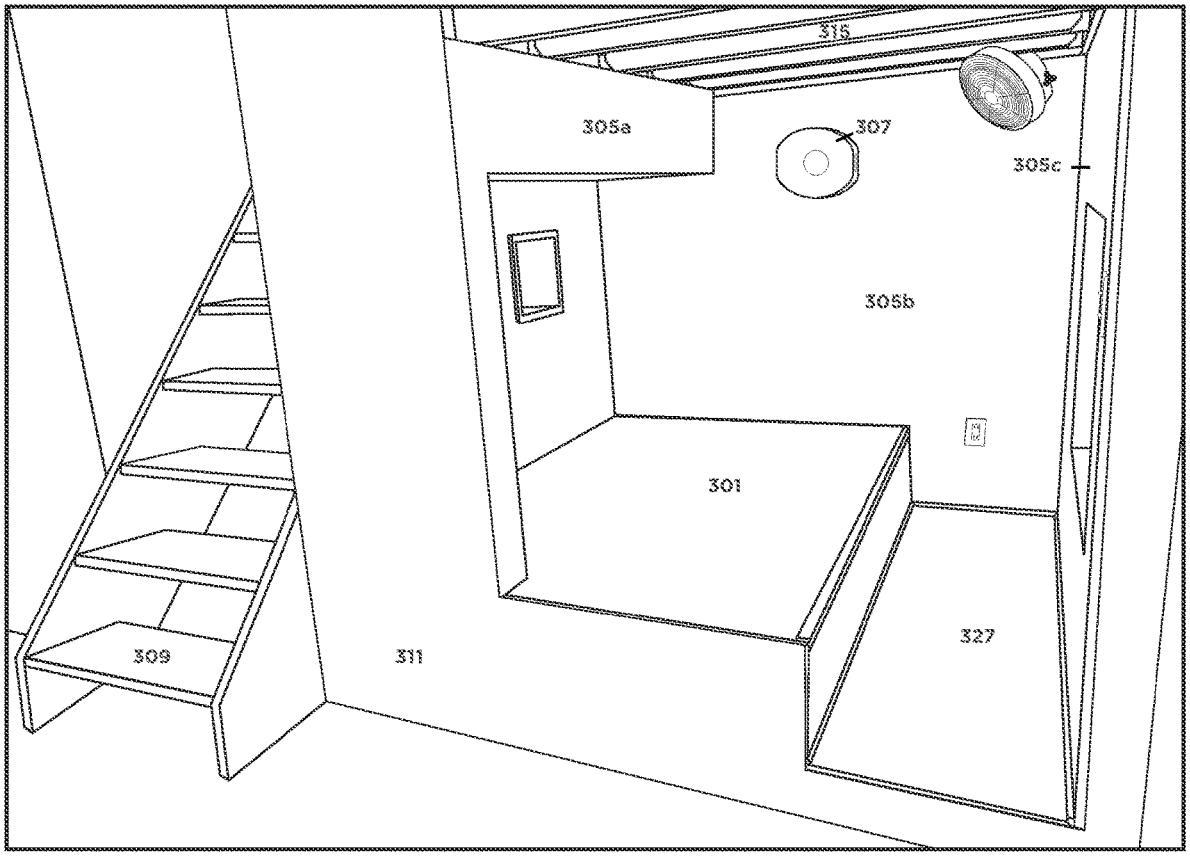
FIG. 3 illustrates the frontal view forth lower bunk with the wood beams overhead and the wood stairs to the left leading to the second level of the loft, in accordance with one implementation of the disclosure.

FIG. 3 illustrates the frontal view forth lower bunk with the wood beams overhead and the wood stairs to the left leading to the second level of the loft, in accordance with one implementation of the disclosure. The lower bunk may include a hallway 327; walls 305*a-c*; a bed frame 301; L-shaped wood beam 311; a staircase 309; and a light fixture 307.

Figure 4:
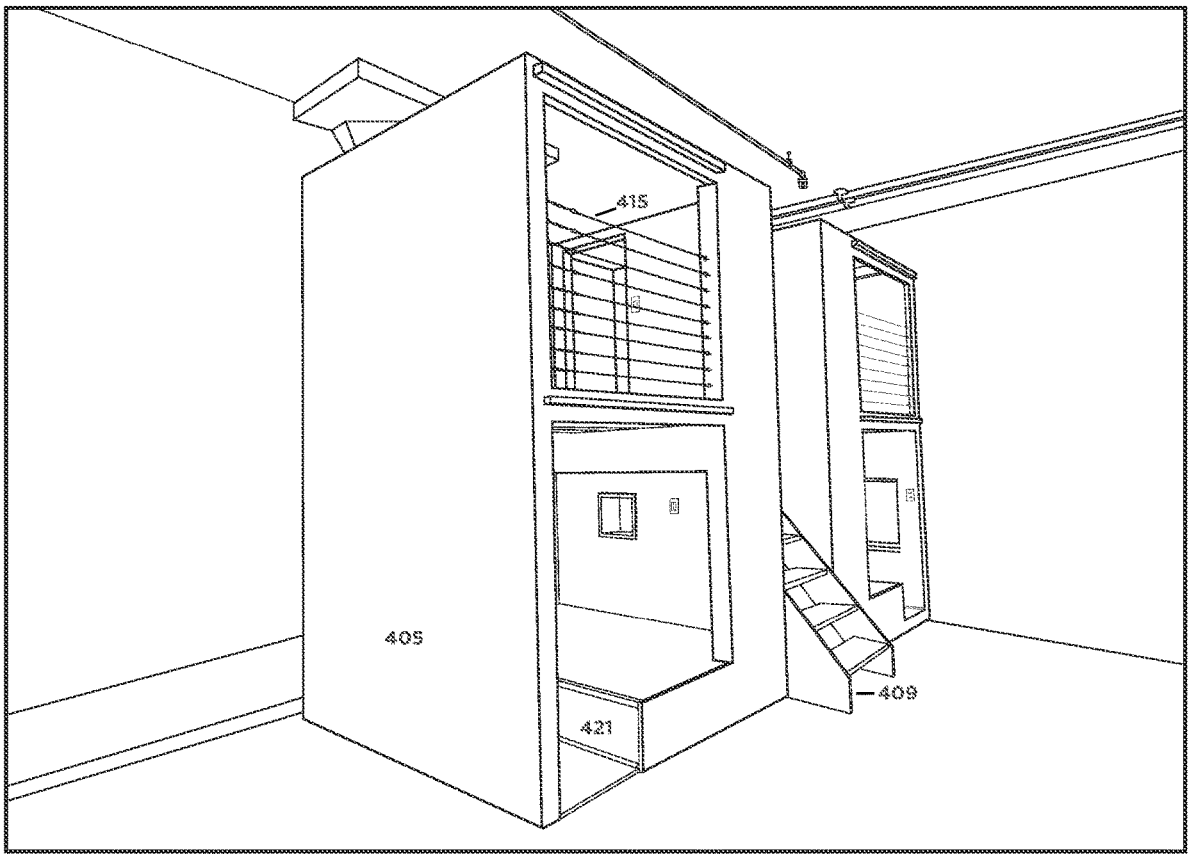
FIG. 4 illustrates the entire bunk bed system from a front diagonal perspective showcasing the wood exterior, pull out drawers for the lower bunks, the wood stairs between each bunk leading to the second level of the loft, and the railing that secures the second level bunk beds, in accordance with one implementation of the disclosure.

FIG. 4 illustrates the entire bunk bed system from a front diagonal perspective showcasing the wood exterior, pull out drawers for the lower bunks, the wood stairs between each bunk leading to the second level of the loft, and the railing that secures the second level bunk beds, in accordance with one implementation of the disclosure. The upper level bunk may include a rail 415; drawers 421; a staircase 409; and an outer wall structure 405 holding together the entire bunk bed assembly.

Referring to FIG. 2, one embodiment of the present disclosure may include an open bunk bed frame with 2×6 exposed wood beams 211 enclosing two lower bunk beds 201*c* and 201*d* with two upper bunk beds 201*a* and 201*b*. A staircase 209 leading to the upper level separates the two lower bunks. The stairs 209 may extend to the ceiling of the lower level lofts instead of to the height of the upper bunks. Where normally drywall would create the floor (117 in FIG. 1) for the upper level and the ceiling of the lower level enclosing the lower level space, wood support beams (315 in FIG. 3) extend from each side of the staircase 309 to the opposite outer wall 305*c* thereby providing the foundation for the upper level while maintaining a more spacious feel for the lower level pods.

Referring to FIG. 3, in one implementation, each of the four sleeping quarters is itself a loft with a hallway 327, a space for a bed 301, and wall space 305*a-c* formed by the outer enclosure of the loft system. The wall space 305*b* may include wiring to provide lighting 307. The lower bunks may each positioned against the wall 305*a* adjoining the staircase 309 so that a hallway 327 is created to the other side of the bed 301 between the bed and the opposite outer wall 305*c*.

The double size beds may lay on a raised platform on both levels. In the lower level, the platform (241*c* and 241*d* in FIG. 2) is positioned next to the staircase 309. The hallway 327 that is created to the opposite side of the platform is tall enough to allow the user to stand upright and provides space for a full-body length mirror on the back wall. At the top of the staircase is a landing 219 (FIG. 2) for the upper level which connects the two upper bunks.

The beds 201*a-b* on the upper level (FIG. 2) are positioned against the outer wall of the unit creating the hallway from the top landing 219 of the staircase to each of the upper bunks. This space is created by taking square footage from above the beds of the lower level pods (i.e., lower level individual sleeping quarters). The top of the loft system is open to allow the top users to also be able to stand upright, and results in an overall more spacious feel. The upper level pods likewise provide space for a full-body length mirror on the back wall. The top-level bunks may have a railing 415 (FIG. 4) that forms a frame from the outer wall to the staircase. The lower-level bunks do not have the railing but instead are flanked with L shaped wood beams 311 (FIG. 3) extending from the wall of the staircase to toward the outer walls. In one embodiment, while the upper level bunks each have the railing 415, the lower bunks do not; instead they are framed by the wood extending from either side of the staircase.

The wall created by the L shaped wood beams 311 (or 211 in FIG. 2) creates a privacy wall and provides a space for the user to hang a television. Each of the four pods may be lined with fully enclosed curtains to provide privacy. The curtains may have the ability to be locked for additional user privacy and security. In the lower level pods, the wall created by the staircase may have an additional cubby hole which extends into the void under the staircase. The upper level pods may have two sets of curtains; one at the opening of the pod at the landing of the staircase, and the other on the side of the railings. Each pod may have connections for light, televisions and a fan. The entire system may sit on a 6-inch platform and need not be affixed to the wall of the room in which the furniture is to be placed. The lower level loft to the left of the staircase may have access to a window and corresponding curtain. The landing at the top of the staircase may include a hatch that can be opened for access to the space under the stairs, and which may store the electrical wires for each of the pods.

The foregoing description of possible implementations consistent with the present disclosure does not represent a list of all such implementations or all variations of the implementations described. The description of some implementations should not be construed as an intent to exclude other implementations described. For example, artisans will understand how to implement the disclosed embodiments in many other ways, using equivalents and alternatives that do not depart from the scope of the disclosure. Moreover, unless indicated to the contrary in the preceding description, no particular component described in the implementations is essential to the invention. It is thus intended that the embodiments disclosed in the specification be considered illustrative, with a true scope and spirit of invention being indicated by the following claims. Further, the limitations of the following claims are not written in means—plus-function format and are not intended to be interpreted based on 35 U.S.C. 112(f), unless and until such claim limitations expressly use the phrase "means for" followed by a statement of function void of further structure.

What is claimed is:

1. A bunk bed loft system comprising: a center staircase adjoining two lower level bed pod units and two upper level bed pod units, wherein the staircase is connected to and located in between a first inner wall to a left side of the staircase and to a second inner wall to a right side of the staircase; a first outer wall on a left side of the bed loft system; a second outer wall on a right side of the bed loft system; a back wall connected to the first and second inner walls and to the first and second outer walls; a first set of support beams extending in a leftward direction from the first inner wall and connecting to the first outer wall, wherein the first set of support beams are covered by flooring and are positioned at a height in between a top section and a bottom section of the back wall; a second set of support beams extending in a rightward direction from the second inner wall and connecting to the second outer wall, wherein the second set of support beams are covered by flooring and are positioned at a height in between a top section and a bottom section of the back wall; and a landing area connected to the back wall and a top portion of the staircase; wherein the first inner wall includes a door opening at a height above said first set of support beams and is accessible from the landing area, and the second inner wall includes a door opening at a height above said second set of support beams and is accessible from the landing area; wherein at least one pod includes a raised bed platform and a hallway enabling a user to stand up; and wherein the landing area is located at a height that is even with the flooring covering the first or the second set of support beams.

2. The bunk bed loft system of claim 1, wherein all pods include the raised bed platform and the hallway.

3. The bunk bed loft system of claim 1, wherein the bed platform includes pull out drawers.

4. The bunk bed loft system of claim 2, wherein the bed platform includes pull out drawers.

5. The bunk bed loft system of claim 1, further comprising:

a first L-Shaped front wall connected or integrated with said first inner wall; and a second L-Shaped front wall connected or integrated with said second inner wall.

6. The bunk bed loft system of claim 1, wherein the first and second set of support beams are made of wood.

* * * * *